United States Patent [19]

Bellew et al.

[11] Patent Number: 4,898,106

[45] Date of Patent: Feb. 6, 1990

[54] COMBUSTION METHOD AND APPARATUS

[75] Inventors: Roy G. Bellew, Thermopolis; Donald P. Dunn, Gillette, both of Wyo.; Charles T. Stilwell, Midland, Tex.; Johnny D. Wood, Moorcroft, Wyo.

[73] Assignee: Atlantic Richfield Company, Los Angeles, Calif.

[21] Appl. No.: 378,340

[22] Filed: Jul. 10, 1989

[51] Int. Cl.[4] ..... F23G 00/00; F23J 15/00; F24F 9/00

[52] U.S. Cl. ..... 110/346; 110/297; 110/203; 110/320; 98/36

[58] Field of Search ..... 110/297, 235, 203, 346, 110/320; 98/36

[56] References Cited

U.S. PATENT DOCUMENTS

| | | | |
|---|---|---|---|
| 3,483,832 | 12/1969 | Boll et al. | 110/203 |
| 3,704,676 | 12/1972 | Davies et al. | 110/203 |
| 3,773,000 | 11/1973 | Applegate | 110/203 |
| 3,899,984 | 8/1975 | Keyes et al. | 110/203 |
| 4,161,916 | 7/1979 | Applegate | 110/203 |
| 4,739,712 | 4/1988 | McPherson | 110/297 |
| 4,756,258 | 7/1988 | Gilbert | 110/235 |
| 4,776,286 | 10/1988 | Blair | 110/297 |

*Primary Examiner*—Henry A. Bennet
*Assistant Examiner*—Denise L. Ferensic
*Attorney, Agent, or Firm*—Roderick W. MacDonald

[57] ABSTRACT

A method and apparatus for burning a combustible material in a closed container having an open top wherein a sheet of oxygen containing gas is forced into the burning chamber of such container, wherein, in forming the sheet of oxygen containing gas, a majority of the gas which is to be formed into a sheet is forced away from the central section of the sheet towards the end sections of the sheet that are situated on either end of the central section and wherein the interior volume of the burning chamber can be varied by use of a movable wall means so that the combined effect of the gas sheet formed in the foregoing manner and the adjusted internal volume of the burning chamber in relation to the specific material to be burned yields an efficient combustion process as evidenced by minimal production of opaque smoke.

20 Claims, 2 Drawing Sheets

COMBUSTION METHOD AND APPARATUS

BACKGROUND OF THE INVENTION

It is known to use in combination with an open topped burning chamber a device for directing a curtain of air along a predetermined path into and around the burning chamber to enhance the oxidation of the material burning therein and to reduce the amount of smoke produced. It is also known that in carrying out such a process an elongated nozzle assembly is useful in forming the desired curtain of air. For example, U.S. Pat. Nos. 3,773,000, issued Nov. 20, 1973 and 4,161,916, issued July 24, 1979, both to Applegate are directed to such a process, and apparatus. The thrust of these two patents is toward a specific nozzle structure in relation to the formation of the air curtain. Another pertinent patent is U.S. Pat. No. 3,899,984, issued Aug. 19, 1975 to Keyes, et al, which is directed to apparatus for carrying out the above-described method wherein multiple gas streams are employed instead of a single air curtain.

It has now been found that by adjusting the volume of air or other oxygen containing gas in its distribution across the air curtain itself, in combination with varying the interior volume of the burning chamber itself, an even greater efficiency in the burning process is achieved which results in both a reduced amount of produced smoke, and therefore a reduced opacity of emissions emanating from the burning process.

BRIEF SUMMARY OF THE INVENTION

In accordance with this invention there is provided a method for burning a combustible material in a burning chamber of an open-topped container, the method employing a sheet or curtain of oxygen containing gas that is directed into the burning chamber during combustion. In the method of this invention, when forming the sheet of oxygen containing gas by use of an elongated opening such as a nozzle means, a majority (more than fifty percent by volume) of said gas is diverted away from the central portion of the gas sheet toward the end sections of the gas sheet that extend on either side of the center portion while leaving a minority (less than fifty percent by volume) of such gas for the center section. In addition, the interior volume and geometry of the burning chamber is varied depending on the particular material and volume of material to be burned so that the combined effect of the thus composed gas sheet and the adjusted interior volume in relation to the specific material being burned in the chamber yields a very efficient combustion process as evidenced by minimal production of black smoke, i.e. minimal opacity. Even in efficient combustion processes, with some materials it is difficult to totally eliminate the production of black smoke, but black smoke production can be substantially minimized, and in some situations eliminated, in the practice of this invention.

Also in accordance with this invention there is provided apparatus for carrying out the foregoing process wherein the apparatus for forming the desired gas sheet or curtain which is to be injected into the burning chamber of the container includes diversion means for directing a majority of the gas stream which is being used to make up said gas sheet toward the end sections of the gas sheet while leaving a minority of such gas for the center section of such gas sheet and wall means movably carried in the interior of the burning chamber so that movement of such wall means effectively alters the volume and geometry of the chamber in which combustion is to take place.

Accordingly, it is an object of this invention to provide a new and improved method for carrying out an efficient combustion process in an open-topped container. It is another object to provide new and improved apparatus for carrying out an efficient combustion process in an open-topped container. It is another object to provide an improved method and apparatus wherein a curtain of air is directed along a predetermined path into a burning chamber.

Other aspects, objects and advantages of this invention will be apparent to those skilled in the art from this disclosure and the appended claims.

DETAILED DESCRIPTION

Figure 1:
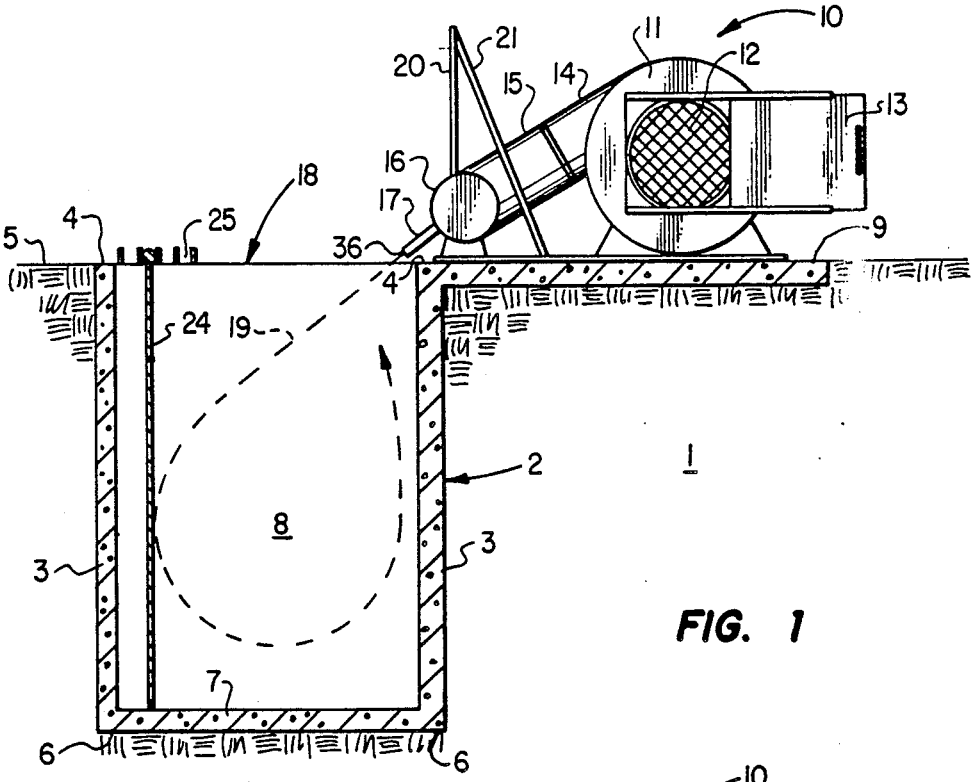
FIG. 1 shows a vertical cross sectional view of apparatus useful in this invention.

In accordance with this invention, FIG. 1 shows the earth 1 having a burning pit or container 2 cut into the surface thereof. Pit 2 has a plurality of closed sides on walls 3 whose upper edges 4 terminate at the earth's surface 5 and whose lower edges 6 are joined and closed by a bottom 7 thereby to define an open-topped container having an interior burning or combustion chamber 8 of finite interior volume. Adjacent at least one upper edge 4 of at least one of the closed sides 3 is disposed at the earth's surface a support pad 9 which carries apparatus 10 for forming and forcing an air sheet or curtain into the interior volume of chamber 8. Apparatus 10 is composed of an air blower 11 with inlet means 12 and a sliding door 13 for controlling the volume of air taken in for formation of the desired sheet of air. Although air will be used hereinafter in describing this invention, any oxygen containing gas capable of maintaining combustion is within the scope of this invention.

Outlet conduit 14 of air blower 11 is connected to a conduit means 15 which directs the entire output of blower 11 into elongated plenum means 16. Air exits plenum means 16 through nozzle means 17 which itself is elongated in the lateral or width dimension when viewing the nozzle opening 36 from chamber 8 and restricted in the vertical dimension so as to form a sheet of air. When nozzle means 16 is angled as shown in FIG. 1 in relation to open top 18 of chamber 8 the air sheet is forced through open top 18 into chamber 8 towards the opposing closed side 3 and around the interior of chamber 8 as shown by dotted line 19. Air sheet 19 thus curves around in chamber 8 to form a circulating current of air in the chamber in which material is burning. Plenum 16 carries heat shield means 20 which is supported by bracket means 21.

A movable wall means 24 which is essentially coextensive with one of the closed sides 3 is carried at the upper edge 4 of at least one other closed side 3. Movable wall 24 is held in any predetermined position by a series of notch means 25 carried along at least one upper edge 4, preferably two opposing upper edges 4 as is shown in better detail in FIG. 2. This way movable wall means 24 can be moved towards or away from nozzle means 17 thereby effectively decreasing or increasing the internal volume of combustion chamber 8.

Figure 2:
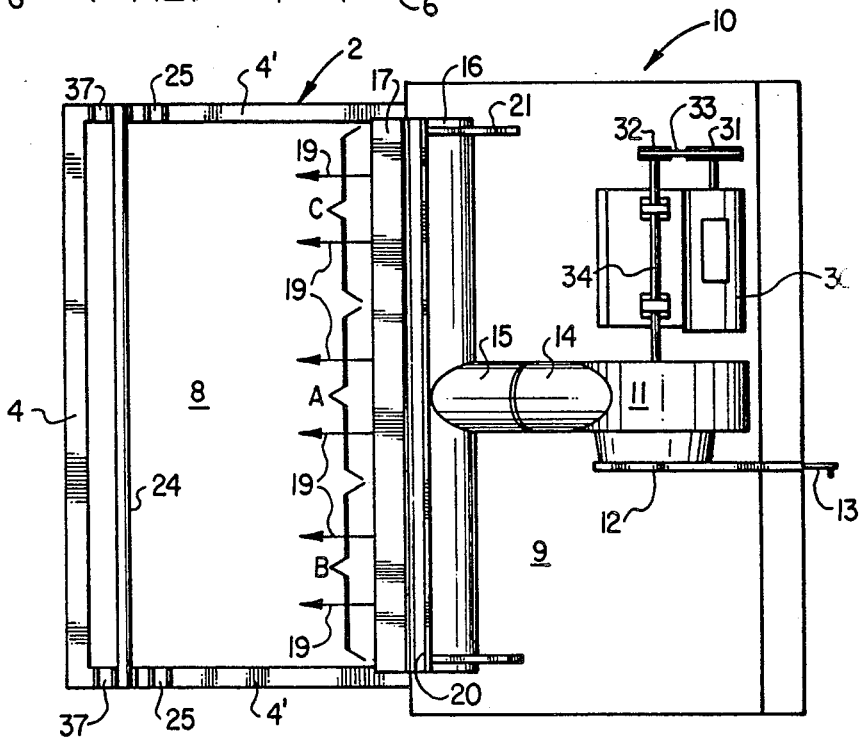
FIG. 2 is a top view of the apparatus of FIG. 1.

FIG. 2 shows the apparatus of FIG. 1 and in addition shows motor means 30 which is connected by means of conventional pulleys 31, 32, and fan belt 33 or other conventional drive means to fan shaft 34 for driving blower 11. It can also be seen from FIG. 2 that nozzle means 17 for forming air sheet 19 extends for essentially the width of opposing closed side 3 so that air sheet 19, when forced through the elongate opening 36 of nozzle means 17, has a width which extends across a substantial portion of open top 18, i.e., in the case of FIG. 2, essentially the entire width of closed side 3. Sheet 19 can further be seen from FIG. 2 to have a width that is dictated by nozzle means 17 which is composed of a center section A which is of a width in relation to the cross-sectional area of the elongate opening 36 of nozzle means 17 so that no more than about one-third, preferably no more than about one-fourth of the air volume used to form sheet 19 is directed to center section A, the remainder of the air being split between end sections B and C. The remaining air is preferably split essentially equally between said end sections.

Figure 3:
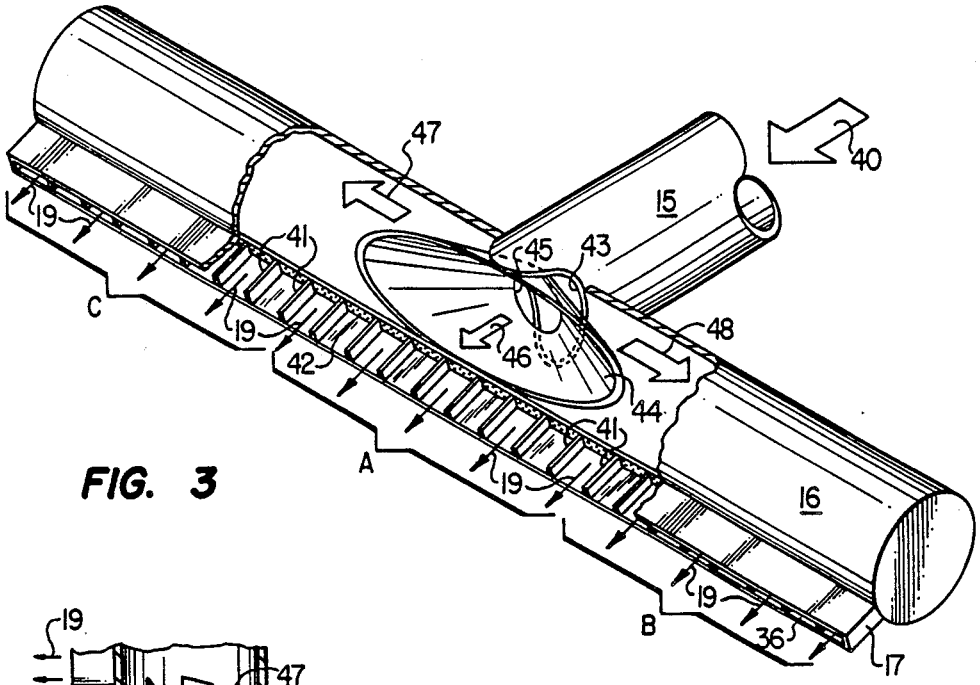
FIG. 3 is a cut-away isometric view of the plenum and diverting means for forming the gas sheet used in this invention.

The cross-sectional configuration of pit 2 can be any desired geometrical configuration, two of the more preferred configurations being square or, as shown in FIG. 2, rectangular. Movable wall 24 is preferably essentially coextensive with one of the closed sides and when the cross-sectional area is rectangular is preferably coextensive with one of the longer closed sides as shown in FIG. 2, although it could be made coextensive with one of the shorter closed sides of the rectangle if desired. As shown in FIG. 2 movable wall 24 is supported by upper edges 4, of the opposing shorter walls of the rectangle, wall 24 having extensions 37 at the top edge thereof which extend across and rest upon both upper edges 4, Extensions 37 also mate with opposing notch means 25 which are carried on both opposing upper edges 4, FIG. 3 shows conduit means 15 carrying a gas stream 40 from blower 11 towards plenum 16. Plenum 16 is elongate and coextensive with elongate nozzle means 17. Nozzle means 17 carries a plurality of spaced apart divider means 41 which orient the flow of air sheet 19 towards movable wall 24. In all or part of center section A an additional flow restricter 42 such as a perforated plate can be employed if desired, although this is not necessary in order to obtain the advantages of this invention. At air outlet end 43 an elliptical cone baffle 44 is employed. Baffle 44 has at least one aperture 45 at or near a central portion thereof to allow a minority of air, represented by arrow 46, to be split from air stream 40 and passed into center section A of nozzle means 17. The remainder, majority, of air stream 40 is split into two portions, as represented by arrows 47 and 48, each of which portions are directed towards end sections B and C that are disposed on opposite ends of center section A. Sections A, B, and C compose in combination the full width of nozzle means 17 and opening 36. This way a majority by volume of air stream 40 received by plenum 16 from conduit means 15 is diverted towards the two end sections of the air sheet which is formed by nozzle means 17, thereby leaving a minority by volume of air stream 40 for the center section of sheet 19 as formed in nozzle 17. It has been found by actual experience with baffle 44 that by distributing air stream 40 as just described so that center stream split 46 is a minor portion of stream 40 while the majority of stream 40 is distributed to side stream splits 47 and 48, the results are an even distribution of air over the entire nozzle width (Sections A, B, and C) as represented by uniform size and width arrows 19. Center section A generally is of a width which is less than one half the full width of opening 36, i.e., the combined widths of sections A, B, and C, and is preferably from about 20% to about 40% of such full width.

Figure 4:
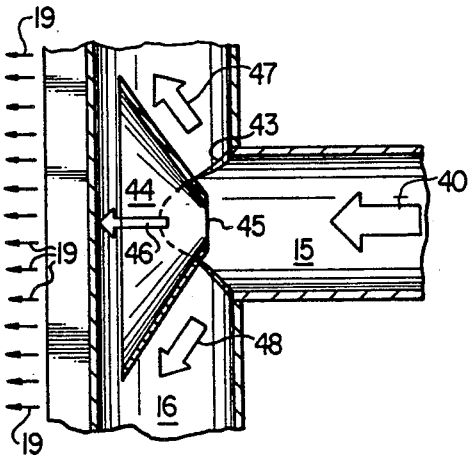
FIG. 4 is a top view of the apparatus of FIG. 3.
Figure 5:
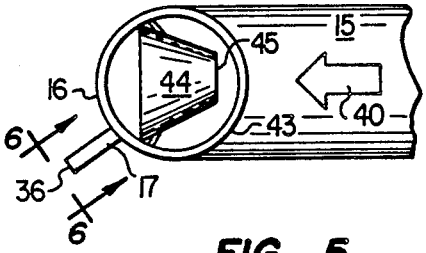
FIG. 5 is a side view of the apparatus of FIG. 3.

FIG. 4 shows a top view of the apparatus of FIG. 3 and shows baffle 44 to carry aperture 45 essentially at the apex of the cone. This relationship can be similarly observed from side view FIG. 5.

Figure 6:
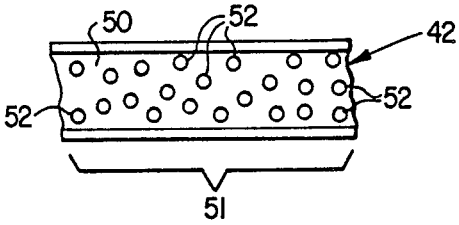
FIG. 6 is a frontal view of the flow restricter means employed in FIG. 3.

FIG. 6 shows flow restricter 42 to be composed of an elongate plate 50 or similar member whose height is about the height of opening 36 and whose width 51 is essentially the same as the width of center section A, although it can have a shorter width as shown in FIG. 3. Plate 50 has a plurality of apertures 52 therein to allow air to flow from inside nozzle 17 out of same and toward open top 18.

In operation the method and apparatus of this invention can be employed to burn most any combustible material that can be disposed in the open top chamber described hereinabove and is combustible with oxygen, preferably in an open air environment. For example, this invention can be employed on most any subdivided or subdividable material that will burn and when so employed will increase the efficiency of the burn and decrease the opacity of the smoke generated by the burn thereby yielding a simpler, less costly, but more efficient combustion process and apparatus. This invention has been employed with substantial success on excelsior which is used in oil field heater treaters. The excelsior is a cellulosic fiber which becomes, during its use in the heater treater, contaminated with hydrocarbonaceous materials such as crude oil and related fluids. Waste material such as oil contaminated excelsior is loaded into chamber 8 and the fire started to burn, for example, by sprinkling the material in chamber 8 with a more volatile hydrocarbonaceous fluid such as diesel oil, kerosene, gasoline, and the like and then dropping a burning member onto this starter fluid soon after it is sprayed onto the material in the chamber. After the fire is lit manually it is allowed to burn for a time so that a sustainable fire is established before blower 11 is turned on. After the blower 11 is actuated the amount of air flow reaching chamber 8 from nozzle 17 is controlled by manual adjustment of sliding door 13 for the most efficient and clear burn possible, based primarily upon direct observation by the operator of the opacity of the smoke leaving chamber 8. Reference herein to black smoke production or, more broadly, opacity of the smoke emitted by way of the process and apparatus of this invention is based upon use of the standard Environmental Protection Agency test referred to as Method 9 and entitled Visual Determination of Opacity of Emissions From Stationary Sources, 40 CFR, Chapter 1, July 1, 1987 Edition, which is incorporated herein by reference. Air is discharged from nozzle 17 in a flat, steady sheet which enhances the combustion process being carried on in chamber 8 due to the increased flow of oxygen to the combustion process and the sheet's distribution across the chamber's opening as shown in FIG. 1 The air sheet acts to contain burned ash material which would normally escape before being completely burned and thereby create more opaque smoke. The ash material is entrained in air sheet 19 and recirculated into the combustion area for reburning and more complete combustion, and for the attainment of a higher burning temperature without the use of sophisticated equipment or additional fuel input. Burning pit 2 can be disposed on the top of the earth's surface or in the earth's surface as shown in FIG. 1, the latter being preferred for better heat conservation and a higher combustion temperature.

In the operation of this invention it is important to obtain, by operator observation and operator adjustment based on such observation, a proper combination of air flow rate into chamber 8, the angle at which air sheet 19 enters chamber 8 and the width of chamber 8 in relation to the air flow rate. Although not presently knowing to a certainty why, the combination of (1) movable walls means and (2) even air sheet distribution (resulting from majority of air to end sections B and C) effectively integrates the air flow rate, the angle the air sheet enters the chamber, and the pit volume and geometry to yield a very efficient combustion process and apparatus which in turn significantly reduces, and in a number of instances totally eliminates, the production of black smoke.

It is further preferred that pit 2 be lined with concrete walls and bottom as shown in FIG. 1 to prevent sloughing of earth into chamber 8, for better heat retention characteristics, and to provide smooth walls in chamber 8 for more laminar flow of air sheet 19 within chamber 8. Generally, pit 2 should be narrow enough to allow air sheet 19 to extend across its entire width and deep enough in proportion to its width to have the burning zone fully contained inside chamber 8 with some vertical space near open top 18 to accommodate air sheet 19 as shown in FIG. 1.

Movable wall means 24 protects pit wall 4 from heat stress since this is the wall of first impingement by air sheet 19 and has the highest exposure to elevated temperatures. Wall 24 further allows adjustment of the inner volume of chamber 19 to a pit geometry that optimizes air circulation within that volume, particularly with changing operating conditions such as ash content in the pit, the amount of material burning in the pit, the opacity of the smoke being generated, and the like.

It has been found in carrying out combustion processes in pits without a movable wall that the pit wall opposite the air blowing apparatus is subjected to very high erosional conditions due to the circulation of hot forced air created by blower 11 and the circulation of air sheet 19 in chamber 8 as shown in FIG. 1. As a result, degradation of the pit's wall cement liner was found to be at least two or three times the rate of any other part of or wall of the pit. This erosion effect was found to be essentially eliminated by the employment of a sheet steel wall 24. A movable metal wall 24 can be replaced with a new wall for a fraction of the cost of repairing cement wall 4.

As an example, oil contaminated cellulosic excelsior was disposed in a rectangular pit in the earth having cross-sectional dimensions of ten feet by eight feet and a depth of twelve feet. The pit was lined on all four vertical sides and its bottom with four inches of concrete and a ten foot by twelve foot carbon steel wall was movably disposed in the pit along one pit wall opposing the air blowing apparatus. The steel wall was placed about ten inches from said pit wall. The air blowing apparatus utilized a fifty horsepower electric motor turning a squirrel cage rotary fan that is normally used in ventilating mine shafts for breathing air. This type of fan is preferred because it has a high volume/low pressure output which is ideal for use in this invention. Conduit means 14 and 15 were approximately twenty-four inches in diameter and these conduits fed nozzle means 17 by way of plenum 16, nozzle opening 36 being about two-and-a half inches in height and ten feet in width. Nozzle 17 was angled in relation to horizontal open top 18 at about forty-five degrees. The pit and equipment were located so that no other buildings, equipment, or the like are within a radius of about twenty feet of the pit and its apparatus.

By use of the foregoing apparatus, oil field heater treater excelsior (hay) was burned sufficiently cleanly to meet essentially all existing state and federal air quality regulations. In burning such hay a load of same was disposed in chamber 8 and about two gallons of diesel oil sprinkled over the top thereof. The fire was then manually started by dropping a burning rag into the chamber. With air inlet 12 closed by sliding door 13, blower 11 was turned on as soon as the fire in the chamber was well established. Thereafter, door 13 was slowly opened based on operator observation of the burn and the opacity of the produced smoke. Once a large fire was established, blower 11 was operated at full capacity thereby obtaining maximum efficiency without blowing the fire out. Door 13 was adjusted until no smoke was observed leaving the pit and only heat waves were observed over the pit.

Additional hay can then be added to such a burn without undue risk. If relatively large batches of additional material are to be fed to a fire there is often a fluctuation in the burn's efficiency and resulting smoke opacity, e.g. a fluctuation from about five to about ten percent opacity, for a few seconds when additional material is first added to what is already burning in chamber 8. The combustion process is thus maintained until all the material to be burned has been fed to chamber 8 and allowed to essentially burn itself down while blower 11 remains operational. Blower 11 should be turned off before substantial amounts of ash and dust tend to be blown out of the burning chamber.

The foregoing apparatus and process can be employed to burn hay from eleven heat treaters, each having a five hundred cubic foot hay capacity. From about two thousand to about four thousand cubic feet of hay can efficiently be burned in an eight hour day depending upon the nature of the oil contamination thereto. A clean burn will yield a volume of ash bearing from about twenty-five to about fifty cubic feet of ash per 1000 cubic feet of contaminated hay burned.

Reasonable variations and modifications are possible within the scope of this disclosure without departing from the spirit of this invention.

What I claim is:

1. In a method for burning a combustible material in a container having closed sides and bottom and an open top, which sides and bottom collectively define an interior burning chamber of finite volume and wherein during burning a sheet of oxygen containing gas is formed in an elongate opening and then forced into the interior of said chamber through said open top, said elongate opening having a center section and end sections on either side of said center section, said sheet of gas having by reason of said elongate opening a width which extends across a substantial portion of said open top, said elongate opening being angled with respect to said open top so that said sheet of gas impinges on at least one of said closed sides and thereafter circulates around the interior of said container before leaving same, the improvement comprising, when forming said sheet of gas in said elongate opening diverting a majority of said gas to said end sections while leaving a minority of said gas for said center section, and varying the interior volume of said burning chamber so that the combined effect of said gas sheet and adjusted interior volume in relation to the specific material being burned in said chamber yield an efficient combustion process as evidenced by minimal production of opaque smoke.

2. The method according to claim 1 wherein more than fifty volume percent of said gas is diverted to said end sections and less than fifty volume percent of said gas is left for said center section.

3. The method according to claim 2 wherein said gas diversion is accomplished by employing a conical baffle.

4. The method according to claim 1 wherein at least one of the interior volume and geometry of said burning chamber is varied by employing a movable wall within said chamber.

5. The method according to claim 4 wherein said movable wall is coextensive with one of said closed sides and is movable within said chamber so that by adjustment toward or away from an opposing closed side said finite volume of said chamber can be decreased or increased, respectively.

6. The method according to claim 1 wherein the center section of said elongate opening comprises less than half the width of the total elongate opening, and the end sections on either side of said center section comprise the remainder of the width of the total elongate opening, said end sections being of approximate equal widths, and no more than about one-third by volume of said gas is directed to said center section and the remainder of said gas is split essentially equally between said end sections.

7. The method according to claim 1 wherein the center section of said elongate opening comprises less than half the width of the total elongate opening, and the end sections on either side of said center section comprise the remainder of the width of the total elongate opening, said end sections being of approximate equal widths, and no more than about one-fourth by volume of said gas is directed to said center section and the remainder of said gas is split essentially equally between said end sections.

8. The method according to claim 1 wherein said chamber is essentially rectangular in cross section, said movable wall is coextensive with the longer of the closed sides and disposed adjacent one of said longer closed sides so said movable wall can be adjusted toward or away from the opposing longer closed side.

9. The method according to claim 4 wherein said movable wall is disposed in said chamber so that said sheet of gas upon entering said chamber first impinges upon said movable wall.

10. An apparatus for burning a combustible material in a container having closed sides which have upper and lower edges and a bottom means closing said lower edges and an open top at said upper edges all of which collectively define an interior burning chamber of finite volume, said chamber having associated with said open top at least one gas blowing means which includes a slot means for forming a gas stream into a sheet of gas, said slot means being angled with respect to said open top so that a sheet of gas being forced from said slot means passes through said open top into the interior of said chamber and towards at least one of said closed walls, said slot means being composed of a center section and end sections on either side of said center section, said slot means having a width which extends across a substantial portion of said open top, the improvement comprising diverter means for directing a majority of said gas stream to said end sections while leaving a minority of said gas stream for said center section, and wall means movably carried in the interior of said chamber, said wall means being essentially coextensive with one of said closed sides so that movement of said wall means effectively alters the volume of the chamber in which burning is to take place.

11. The apparatus according to claim 10 wherein said chamber is essentially rectangular in cross section and thereby has a long axis and a short axis, and said sheet of gas is essentially as wide as one of said short axis or long axis.

12. The apparatus according to claim 10 wherein said diverter means is a baffle means having at least one aperture therein for admitting a minority of a gas stream that is impinging on said diverter means through said at least one aperture and into said center section of said slot means, said diverter means splitting the remainder of said impinging gas stream into two portions and directing each portion toward an end section of said slot means.

13. The apparatus according to claim 12 wherein said diverter means is an elliptical cone baffle with at least one aperture in a central portion thereof.

14. The apparatus according to claim 10 wherein a gas flow restricter means is employed in said center section of said slot means.

15. The apparatus according to claim 10 wherein said wall means is carried in said chamber so that said sheet of gas upon entering said chamber through said open top impinges first upon said wall means.

16. The apparatus according to claim 10 wherein said wall means is movably supported by at least one of said closed sides at the upper edge of said at least one closed side.

17. The apparatus according to claim 16 wherein said wall means is movably fixed by notch means at predetermined positions along said at least one upper edge.

18. The apparatus according to claim 10 wherein said movable wall means is essentially coextensive with the closed side that opposes said slot means.

19. The apparatus according to claim 18 wherein said chamber is rectangular in cross section and said movable wall means is carried adjacent to and essentially coextensive with one of the longer closed sides so that said wall means can be adjusted toward or away from the opposing longer closed side, and said slot means is carried adjacent said opposing longer closed side and oriented toward said movable wall means.

20. The apparatus according to claim 19 wherein said diverter means is a baffle means having at least one aperture therein for admitting a minority of a gas stream that is impinging on said diverter means through said at least one aperture and into said center section of said slot means, said diverter means splitting the remainder of said impinging gas stream into two portions and directing each portion toward an end section of said slot means.

* * * * *